United States Patent [19]

Wasson

[11] B 3,984,959

[45] Oct. 12, 1976

[54] STRAP FOR ATTACHING A CEILING TO A STEEL DECK

[75] Inventor: Kenneth L. Wasson, Lancaster, Pa.

[73] Assignee: Armstrong Cork Company, Lancaster, Pa.

[22] Filed: Nov. 11, 1974

[21] Appl. No.: 522,354

[44] Published under the second Trial Voluntary Protest Program on January 20, 1976 as document No. B 522,354.

[52] U.S. Cl. ..... 52/484; 52/22; 52/712

[51] Int. Cl.[2] ..... E04B 5/52

[58] Field of Search ..... 52/484, 483, 335, 336, 52/39, 710, 630, 712–715, 618, 450, 452, 454, 22, 537; 248/73, 223, 343

[56] References Cited

UNITED STATES PATENTS

| | | | |
|---|---|---|---|
| 1,213,649 | 1/1917 | Hunter | 52/710 X |
| 2,762,398 | 9/1956 | Adam | 52/710 X |
| 3,102,610 | 9/1963 | Shelby | 52/484 |
| 3,266,202 | 8/1966 | Furer | 52/710 X |
| 3,808,763 | 5/1974 | Ollinger | 52/22 |
| 3,812,636 | 5/1974 | Albert | 52/630 |

FOREIGN PATENTS OR APPLICATIONS

| | | | |
|---|---|---|---|
| 537,594 | 5/1955 | Belgium | 52/484 |

*Primary Examiner*—John E. Murtagh

[57] ABSTRACT

A conventional corrugated deck material is used with many roof structures. A strap structure is provided for engaging the corrugations of the deck material so that a conventional ceiling suspension runner for a suspended ceiling system may be suspended from the strap structure.

2 Claims, 5 Drawing Figures

STRAP FOR ATTACHING A CEILING TO A STEEL DECK

BACKGROUND OF THE INVENTION

1. Field of the Invention

The invention herein is directed to a ceiling structure and, more particularly, to an attachment technique for fastening suspension runners to an overlying roof deck system.

2. Description of the Prior Art

There is commercially available on the open market a fluted metal deck which is sold by H. H. Robertson Company, under their trade name "QL-99". This roof deck system contains a plurality of flutes and along both edges of the bottom of each flute there is provided ridges. It is with these ridges that the invention herein is meant to cooperate so as to form a mounting structure for the attachment of a suspended ceiling system or other items to the Robertson roof deck.

U.S. Pat. No. 3,300,912 discloses a ceiling system which uses a metal deck. It is noted that the deck must be provided with peninsular segments 43 which are used as the connecting points for the hanger wires of a suspended ceiling system.

U.S. Pat. No. 3,606,720 discloses a metal roof structure which utilizes a clip to fasten structural elements to the metal decking material. U.S. Pat. No. 3,296,751 is a structure similar to the aforesaid patent wherein a clip structure is mounted on a deck-like structure for the purpose of fastening other structural elements to the deck-like structure.

SUMMARY OF THE INVENTION

The invention herein consists of a strap structure which is used in combination with a Robertson roof deck or similar type deck. This type of deck has a corrugated cross section with a plurality of flutes. The flutes are uniformly spaced and form open regions between the adjacent flutes. At the bottom of each flute there is provided a little ridge in the side of the flute. The sheet metal strap herein is designed to be bowed into the open region between two flutes and the ends of the strap are snapped into two facing ridges on two adjacent flutes. The strap is provided with apertures to which may be fastened hanger wires or hanger brackets to carry different structures such as the suspension runners of a ceiling suspension system.

The invention herein provides for the elimination of other more complicated hanger structures for suspended ceiling members relative a metal roof deck. It also eliminates the need of building-in connection points in the metal roof deck so that tie points will be available to fasten a hanger wire directly to the metal roof deck.

DESCRIPTION OF THE PREFERRED EMBODIMENTS

Figure 1:
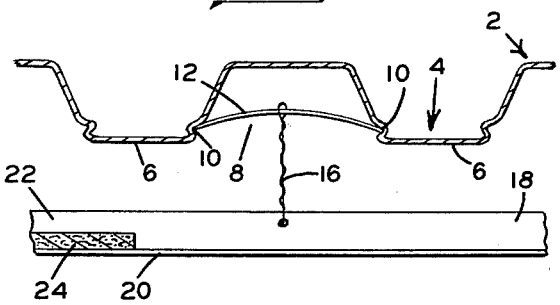
FIG. 1 is an end view of a metal roof deck with the strap invention therein.

The H. H. Robertson Company manufactures a fluted metal deck which they sell under the trade name "QL-99". This particular fluted floor or roof deck is shown in FIG. 1 as element 2. The fluted roof deck is actually a corrugated metal structure which has a series of flutes 4 with their bottoms 6 extending in one common plane. The flutes are uniformly spaced approximately 12 inches apart and have therebetween gaps 8 about 7 inches wide. Along the bottom edges of the flutes there are provided ridges 10 with the ridges of two adjacent flutes 6 facing each other across the gap 8. The flutes and ridges are provided in the metal deck for the purpose of keying to the roof deck a concrete which is poured upon the upper surface of the Robertson roof deck 2.

Figure 2:
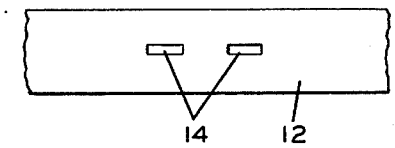
FIG. 2 is a top view of the strap invention herein.

The invention herein takes advantage of the existence of the ridges 10 and their position on either side of the flutes 4, and, the fact that two adjacent flutes have the ridges 10 facing each other across the gap 8. As shown in FIG. 1, a sheet metal strap 12 is fastened to the Robertson roof deck. A top view of the strap is shown in FIG. 2. The strap is normally made approximately 1½ inches wide, approximately 8 inches long and is normally made from No. 20 gauge steel. This strap 12 is provided with two apertures 14. The length of the strap is greater than the spacing between two adjacent ridges 10. The sheet metal strap is bowed into the gap 8 between two adjacent flutes 6 and the ends of the strap are engaged in the ridges 10 as shown in FIG. 1. The strap is thus held in place with a concave configuration which is facing downwardly into the area below the roof deck. In the embodiment of FIG. 1, a conventional hanger wire 16 is passed through the two apertures 14 and the end of the hanger wire is wrapped about the body of the hanger wire to hold the wire in position relative to strap 12. The other end of the hanger wire 16 is fastened to a conventional inverted T-bar ceiling runner structure 18. This is a conventional ceiling suspension member which normally has a plurality of apertures therein. The other end of the hanger wire 16 is passed through one of the apertures of the conventional inverted T-bar runner and wrapped about itself so that the wire will be fastened to the inverted T-bar runner. Generally, the conventional inverted T-bar runner has a vertical web and horizontal flanges on either side of the web. On the horizontal flanges ceiling boards are positioned. In the embodiment of FIG. 1, the horizontal flanges would be elements 20 and they would be positioned on either side of the vertical web 22. Ceiling boards 24 would then rest upon the horizontal flanges 20. A plurality of runner members would be put into position and the horizontal flanges of all the runner members would be put in a common plane so as to form a support gridwork for a ceiling system. The hanger wires are used to adjust the spacing on the conventional inverted T-bar runner from the Robertson roof deck and to permit adjustment of individual runners so that all of the horizontal flanges of all of the runners end up in a common plane.

Figure 3:
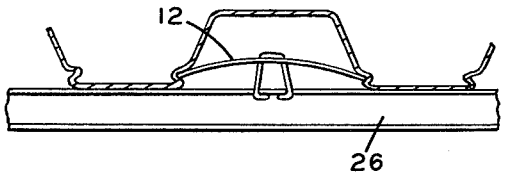
FIG. 3 is a modification of the structure of FIG. 1 wherein a hanger bracket is used instead of a hanger wire in conjunction with the strap invention herein.
Figure 4:
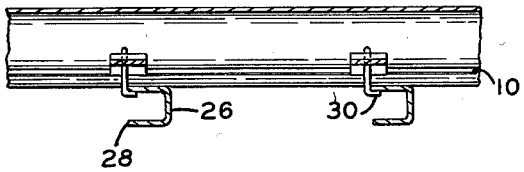
FIG. 4 is an end view of the structure of FIG. 3.

FIG. 3 is another embodiment of the invention herein utilizing the same sheet metal strap 12. The embodiment of FIG. 3 differs from the embodiment of FIG. 1 in that a different type runner structure and hanger structure is utilized. In the embodiment of FIG. 3, a conventional C runner 26 is utilized. In FIG. 4 there is shown the cross section of the conventional C runner 26 and, as can be seen in that figure, the cross section of the runner is basically that of a square sided C. On the lower flange 28 of the C runner, the ceiling boards would be supported. The upper flange 30 of the C runner is the element which will be engaged by the means which clamps the runner in position relative the roof deck structure.

Figure 5:
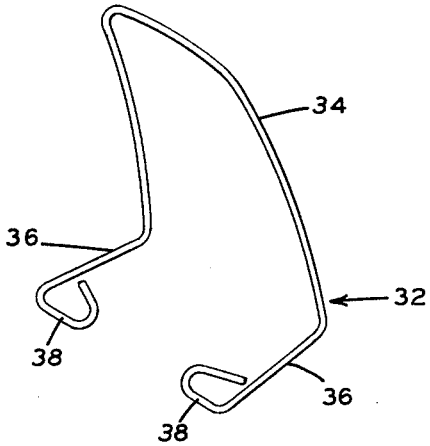
FIG. 5 is a perspective view of the hanger strap used in the embodiment of FIGS. 3 and 4.

FIG. 5 is a showing of the hanger structure or clamp means 32 which is utilized to fasten the C runner to the Robertson roof deck. As can be seen in FIg. 5, the hanger 32 is a generally U-shaped wire 34 having two legs 36 with the ends of the wires 38 turned in against the legs 36. The hanger structure has the two legs 36 passed down through the apertures 14 in the sheet metal strap 12 and then the structure turned 90° so that the U portion of the body 34 of the clamp will be resting upon the sheet metal strap as shown in FIG. 3. The legs 36 of the clamp are now in position to engage the flange 30 of the C runner.

As shown in FIG. 3, the flange 30 of the C runner engages the bottom 6 of the Robertson roof deck. The legs 36 of the clamp means can now engage the flange 30 and hold the C member in position up against the Robertson roof deck. The structure of FIG. 3 differs from the structure of FIG. 1 wherein the FIG. 1 runner structure is supported below the Robertson roof deck, whereas the FIG. 3 runner structure is clamped up against the bottom of the flutes of the Robertson roof deck. In both cases, the sheet metal strap 12 is bowed between the ridges 10 of the Robertson roof deck to provide an anchor point for receiving the support wire or hanger structure which is utilized to hold the ceiling runner in position. It is obvious that the C runner of the embodiment of FIG. 3 could be replaced by conventional Z or H runners which are known in the art.

By increasing the thickness of the sheet metal strap 12 to increase its strength, the strap could be used to support other objects, such as water or drain pipes, conduit, ductwork, light fixtures, etc.

What is claimed is:

1. The combination of a structural roof component and a ceiling system wherein; said structural roof component being formed with a fluted roof deck structure which has a corrugated-type structure with a plurality of parallel extending flutes having their bottoms in a single plane and having therebetween a plurality of gaps, along both edges of the bottom of said flutes there being positioned ridges which form recessed surfaces facing towards said gaps, said ceiling system in combination therewith having a suspension runner for a suspended ceiling system, said suspension runner being fastened to said roof deck through the use of a support means comprising a strap member and a hanger member, said strap member being longer than the distance between two adjacent ridges and having its ends in two adjacent ridges facing each other across a single gap and said strap member being bowed with a concave configuration facing towards said suspension runner, said hanger member being a wire structure passing between and connecting the center of the strap member and a suspension runner suspended below said roof deck structure.

2. The combination of a structural roof component and a ceiling system, wherein; said structural roof component being formed with a fluted roof deck structure which has a corrugated-type structure with a plurality of parallel extending flutes having their bottoms in a single plane and having therebetween a plurality of gaps, along both edges of the bottom of said flutes there being positioned ridges which form recessed surfaces facing towards said gaps, said ceiling system in combination therewith having a suspension runner for a suspended ceiling system, said suspension runner being fastened to said roof deck through the use of a support means comprising a strap member and a hanger member, said strap member being longer than the distance between two adjacent ridges and having its ends engaged in two adjacent ridges facing each other across a single gap and said strap member being bowed with a concave configuration facing towards said suspension runner, said hanger member being a generally U-shaped member connected to the strap member and said suspension runner is placed up against the bottom of the flutes of the roof deck structure and said hanger member clamps said suspension runner up against the bottom of the flutes of the roof deck structure.

* * * * *